United States Patent [19]

Moss

[11] Patent Number: 4,936,212

[45] Date of Patent: Jun. 26, 1990

[54] FLEXOGRAPHIC PRINTING PLATE TRANSFER TRAY FOR MOUNTER-PROOFER MACHINE

[75] Inventor: Lester I. Moss, Hackensack, N.J.

[73] Assignee: Mosstype Corporation, Waldwick, N.J.

[21] Appl. No.: 345,407

[22] Filed: May 1, 1989

[51] Int. Cl.[5] ..... B41F 27/06; B41L 29/06

[52] U.S. Cl. ..... 101/216; 101/415.1; 101/481; 101/DIG. 36

[58] Field of Search ..... 101/216, 219, 415.1, 101/DIG. 36, 481; 156/384, 447, 475, 510; 33/614, 616, 617, 618, 620, 621, 619; 29/21

[56] References Cited

U.S. PATENT DOCUMENTS

| | | | |
|---|---|---|---|
| 2,104,553 | 1/1938 | Claybourn | 101/DIG. 36 |
| 2,334,821 | 11/1943 | Hawley | 101/DIG. 36 |
| 2,559,533 | 7/1951 | Daniels | 101/DIG. 36 |
| 2,711,691 | 6/1955 | Leavens, Jr. | 101/216 |
| 3,550,283 | 12/1970 | Bernardi et al. | 101/DIG. 36 |
| 3,983,808 | 10/1976 | Jackson | 101/401.3 |
| 4,019,434 | 4/1977 | Hoexter | 101/DIG. 36 |
| 4,750,248 | 6/1988 | Brown | 29/51 |

FOREIGN PATENT DOCUMENTS

| | | | |
|---|---|---|---|
| 15471 | 9/1980 | European Pat. Off. . | |
| 1273989 | 7/1968 | Fed. Rep. of Germany | 101/DIG. 36 |
| 62-221541 | 9/1987 | Japan . | |

*Primary Examiner*—J. Reed Fisher

*Attorney, Agent, or Firm*—Michael Ebert

[57] ABSTRACT

A machine to facilitate the mounting of flexographic printing plates and for obtaining proofs thereof. The machine includes an impression cylinder supported for rotation on a fixed axis, the impression cylinder making contact with printing plates on a plate cylinder and rotating concurrently therewith to print a proof on the impression cylinder. The plate cylinder is movable from a proofing state in which it makes contact with the impression cylinder to a mounting state in which it is separated therefrom. The flexographic printing plate to be mounted is provided with registration holes and lies on a support tray shiftable from a retracted position displaced from the plate cylinder in its mounting state to an operative position in which its leading edge is parallel to the axis of the plate cylinder and tangentially engages the surface thereof. Located on the tray are registration pins whose sites are adjustable so as to place the pins within the registration holes of the printing plate, the front margin of the plate then overhanging the leading edge of the tray and overlying the plate cylinder. The surface of the plate cylinder is sticky and the front margin of the plate is adhered thereto. The printing plate is then disengaged from the pins and the plate cylinder is rotated to transfer the remainder of the printing plate onto its surface, after which the tray is retracted to permit the plate cylinder on which the printing plate is now mounted, to be moved from its mounting state to its proofing state in which the printing plate engages a proof sheet on the impression cylinder.

7 Claims, 6 Drawing Sheets

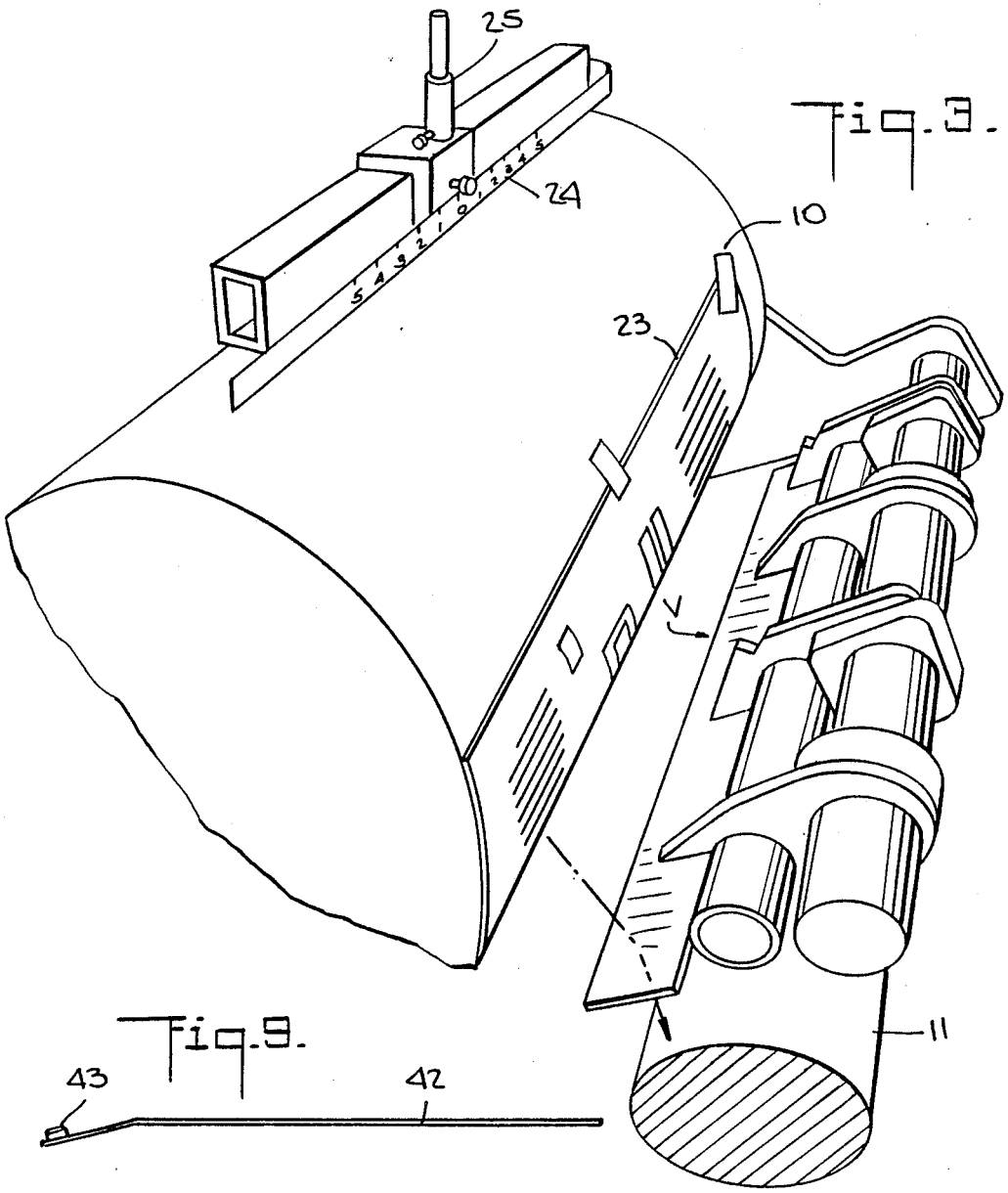
Fig. 3.
Fig. 9.
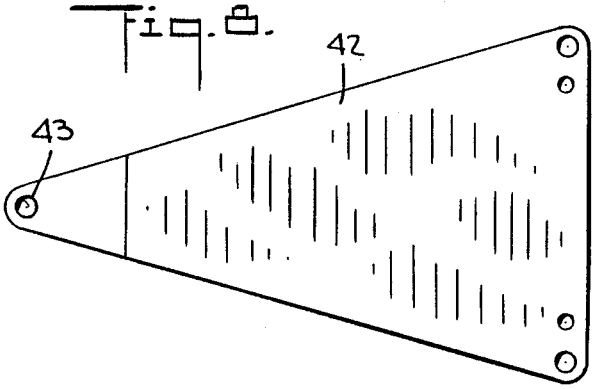
Fig. 8.
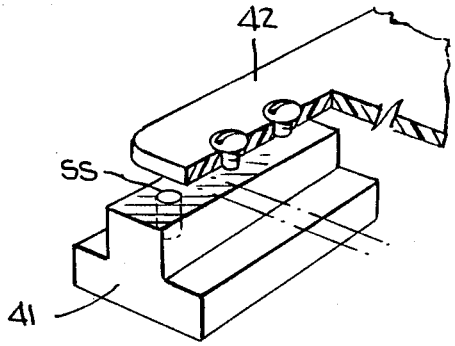
Fig. 11.

FLEXOGRAPHIC PRINTING PLATE TRANSFER TRAY FOR MOUNTER-PROOFER MACHINE

BACKGROUND OF INVENTION

1. Field of Invention:

This invention relates to machines to facilitate the registration and mounting of flexographic printing plates on a plate cylinder and for obtaining proofs thereof on an impression cylinder, and more particularly to a mounting-proofing machine provided with a support tray to facilitate the transfer of flexographic printing plates to desired mounting positions on the plate cylinder.

2. Status of Prior Art:

In the flexographic process, printing is conventionally effected by flexible printing plates mounted on cylinders, the paper to be printed being impressed by the inked printing plate. The cylinder on which the printing plates are mounted is generally called the plate cylinder. The quality of a flexographic printing job depends, in large measure, on the care with which prepress preparations are carried out. Plate-mounting, color registration and proofing are effected off the press by means of commercially available mounting-proofing machines designed for this purpose.

These machines, which usually make use of an optical mounting system, make it possible to mount the plates on plate cylinders to effect exact color registration, a procedure essential to the maintenance of both quality and economy in all flexographic operations. Pre-proofing is, in many respects, the most important of all prepress preparations, for it not only indicates the appearance of the final reproduction, but it also affords means to check the mounting of the plates for color sequence, spacing requirements, layout and gear size as well as copy and color separation.

Mounting-proofing machines are provided with a proofing cylinder (also called the impression cylinder) which cooperates with the plate cylinder, the impression cylinder making contact with the printing plates on the plate cylinder and rotating concurrently therewith to print a proof on a sheet secured to the proofing cylinder. In some commercial machines of the type presently available, the proofing or impression cylinder is supported for rotation at a fixed position, whereas the plate cylinder is movable in a vertical plane, from a mounting state in which it is retracted relative to the proofing cylinder to a proofing state in which it is in engagement therewith. One such machine is the M15 Mounter-Proofer manufactured by the Mosstype Corporation of Waldwick, N.J., the assignee of the present application. Also manufactured by this company are M17, M18, M20 and M21 mounter-proofer machines.

The M18 machine includes a line-of-sight viewer which shows the operator both the plate he is mounting on the plate cylinder and an image reflected from the proof sheet on the impression cylinder. By simply merging the two images, the operator sees exactly where to lay the plate on the plate cylinder. The entire viewer assembly automatically raises out of the way, giving unobstructed access to the plate cylinder for close inspection, inking, etc. The viewer returns automatically to the identical viewing position when ready to proceed with mounting.

The impression and plate cylinders are provided with respective gears of the same diameter. These gears are mechanically intercoupled, whereby rotation of the proofing cylinder causes the plate cylinder to rotate in both the mounting state where the cylinders are separated and in the proofing state when the cylinders are in engagement with each other. Mounter-proofer machines for rubber flexographic printing plates are disclosed in U.S. Pat. Nos. 3,361,061 (Hoexter et al.) and 4,004,509 (Moss).

When the diameter of the proofing cylinder is the same as the printing diameter of the plate cylinder (i.e., the diameter of the plate cylinder plus the thickness of the printing plates thereon), then a one-to-one relationship exists therebetween. In practice, however, the plate cylinders come in a range of diameters for different size printing jobs. This is a direct function of plate cylinder circumference which equals the pitch line circumference of the plate cylinder gear. It is necessary, therefore, in the M18 machine and in other mounting-proofing machines operating on similar principles to adjust the phase relationship between the plate and proofing cylinders to accommodate the shift in the surfaces which occur as the printing cylinder moves from its mounting to its proofing position.

Of particular prior art interest is U.S. Pat. No. 4,019,434 (Hoexter), whose entire disclosure is incorporated herein by reference. In this patent, which discloses a mounter-proofer machine, the plate cylinder is movable in a vertical plane from a proofing state in which it makes contact with the impression cylinder to a mounting state in which it is separated therefrom. An optical viewer is provided which is operative in the mounting state to show the operator both the plate he is mounting on the plate cylinder and the image reflected from the proof sheet on the impression cylinder. In order to merge these two images so that the operator sees exactly where to lay the plate on the plate cylinder, means are provided which mechanically interlink the two cylinders and also effect a relative adjustment of their angular positions whereby a given point on the plate cylinder is optically coincident with the corresponding point printed on the impression cylinder.

Mounter-proofer machines of the type disclosed in the above-identified patents are expressly designed for use with traditional flexographic printing plates formed of natural rubber and other materials that are not dimensionally stable. However, in recent years, dimensionally stable flexographic printing plates have been developed that include a synthetic polymeric ply. Such plates have made practical mechanical positioning by pin registration techniques. To this end, the printing plates have registration pin holes drilled therein which are outside of the image area and serve to properly orient the plate on the plate cylinder.

In the "CYREL Registration System" marketed by duPont and described in their bulletin E77968 bearing this title, in order to properly mount a photopolymer plate onto a plate cylinder having a sticky surface to which the plate is adherable, a registration bar is provided having end plates that clamp onto the bearing surfaces of the plate cylinder.

The registration bar is provided with registration pins, the bar when clamped being above and parallel to the plate cylinder. The printing plate to be mounted on the plate cylinder is draped over the bar, with the registration pins on the bar going into the pin holes on the printing plate to properly orient the printing plate whose front portion then makes contact with and adheres to the sticky surface on the plate cylinder. The printing plate is then taken off the bar pins, after which the bar is detached from the plate cylinder and the remaining portion of the printing plate is then smoothed onto the cylinder so that it is now fully mounted thereon.

In the Cyrel Registration System there is a need to manually clamp the registration bar to the plate cylinder each time a printing plate is to be mounted thereon. One must then subsequently remove the bar and then move the plate cylinder to a proofing position for final proofing.

Accordingly, the need exists for a proofing machine that incorporates the features of pin registration to facilitate pin mounting methods in a production environment, and for obtaining proofs thereof to check the mounting of the plates for color sequence, spacing requirements, and for other factors which must be taken into account in high quality flexographic printing.

While the invention will be described in connection with photopolymer flexographic printing plates having registration holes drilled therein, it is to be understood that it is applicable to other types of dimensionally-stable flexographic printing plates provided with registration holes.

SUMMARY OF INVENTION

In view of the foregoing, the main object of this invention is to provide a mounter-proofer machine adapted to facilitate the mounting of flexographic printing plates having registration holes or of printing plates which lack such holes, and for obtaining proofs thereof.

A significant feature of the invention is that the same machine may include an optical viewer to properly mount a traditional rubber printing plate onto the plate cylinder, a pin-registered printing plate being mounted on the plate cylinder without the use of the viewer. Thus depending on the type of printing plate to be mounted, a mounter-proofer machine in accordance with the invention suits either or both requirements.

More particularly an object of this invention is to provide in a mounter-proofer machine for flexographic printing plates a pin-registration facility including a support tray to position and to transfer printing plates having registration holes to a desired position on the plate cylinder.

A salient advantage of the invention as compared to a bar-type pin registration system is that the pin registration facility to effect such registration is integrated with the mounter-proofer machine so that its operation is coordinated with the controls for the plate cylinder in the machine, thereby making it possible to carry out all of the pre-press mounting and proofing procedures in one handling.

Briefly stated, these objects are attained in a machine to facilitate the mounting of flexographic printing plates and for obtaining proofs thereof. The machine includes an impression cylinder supported for rotation on a fixed axis, the impression cylinder making contact with printing plates on a plate cylinder and rotating concurrently therewith to print a proof on the impression cylinder. The plate cylinder is movable from a proofing state in which it makes contact with the impression cylinder to a mounting state in which it is separated therefrom.

The flexographic printing plate to be mounted is provided with registration holes and lies on a support tray shiftable from a retracted position displaced from the plate cylinder in its mounting state to an operative position in which its leading edge is parallel to the axis of the plate cylinder and tangentially engages the surface thereof. Located on the tray are registration pins whose sites are adjustable so as to place the pins within the registration holes of the printing plate, the front margin of the plate then overhanging the leading edge of the tray and overlying the plate cylinder. The surface of the plate cylinder is sticky and the front margin of the plate is adhered thereto. The printing plate is then disengaged from the pins and the plate cylinder is rotated to transfer the remainder of the printing plate onto its surface, after which the tray is retracted to permit the plate cylinder on which the printing plate is now mounted, to be moved from its mounting state to its proofing state in which the printing plate engages a proof sheet on the impression cylinder.

BRIEF DESCRIPTION OF DRAWINGS

For a better understanding of the invention as well as other objects and further features thereof, reference is made to the following detailed description to be read in conjunction with the accompanying drawings, wherein:

FIG. 3 is a perspective view of the machine in its mounting state when used for optical registration;

FIG. 8 is a plan view of a registration-pin extension;

FIG. 9 is an end view of the extension;

FIG. 11 shows, in perspective, a track side block for either direct use in pin registration of a printing plate or for supporting a pin-registration extension.

DESCRIPTION OF INVENTION

Figure 1:
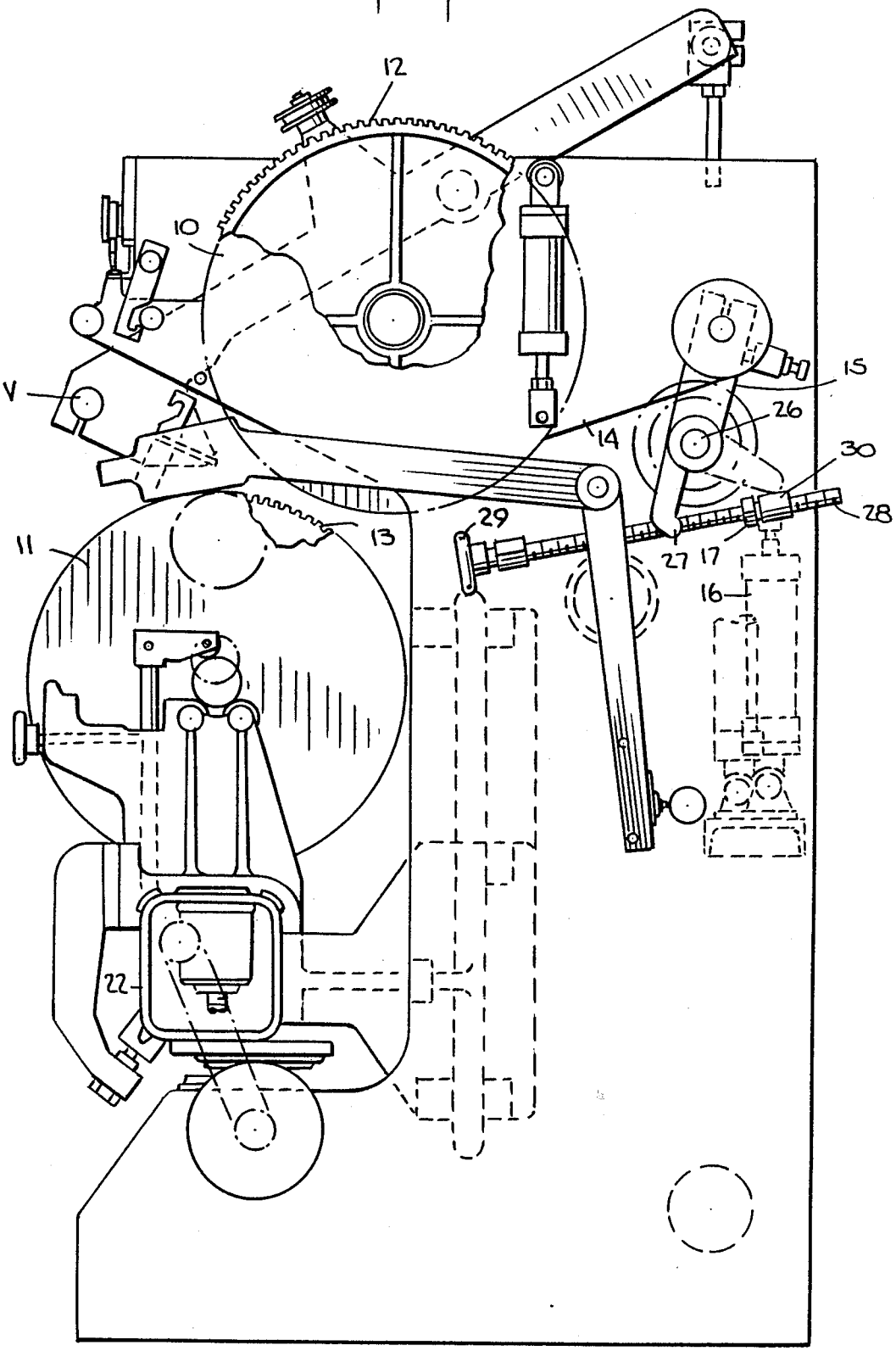
FIG. 1 is an end view of a mounter-proofer machine in accordance with the invention, the transfer tray being omitted from this figure.
Figure 2:
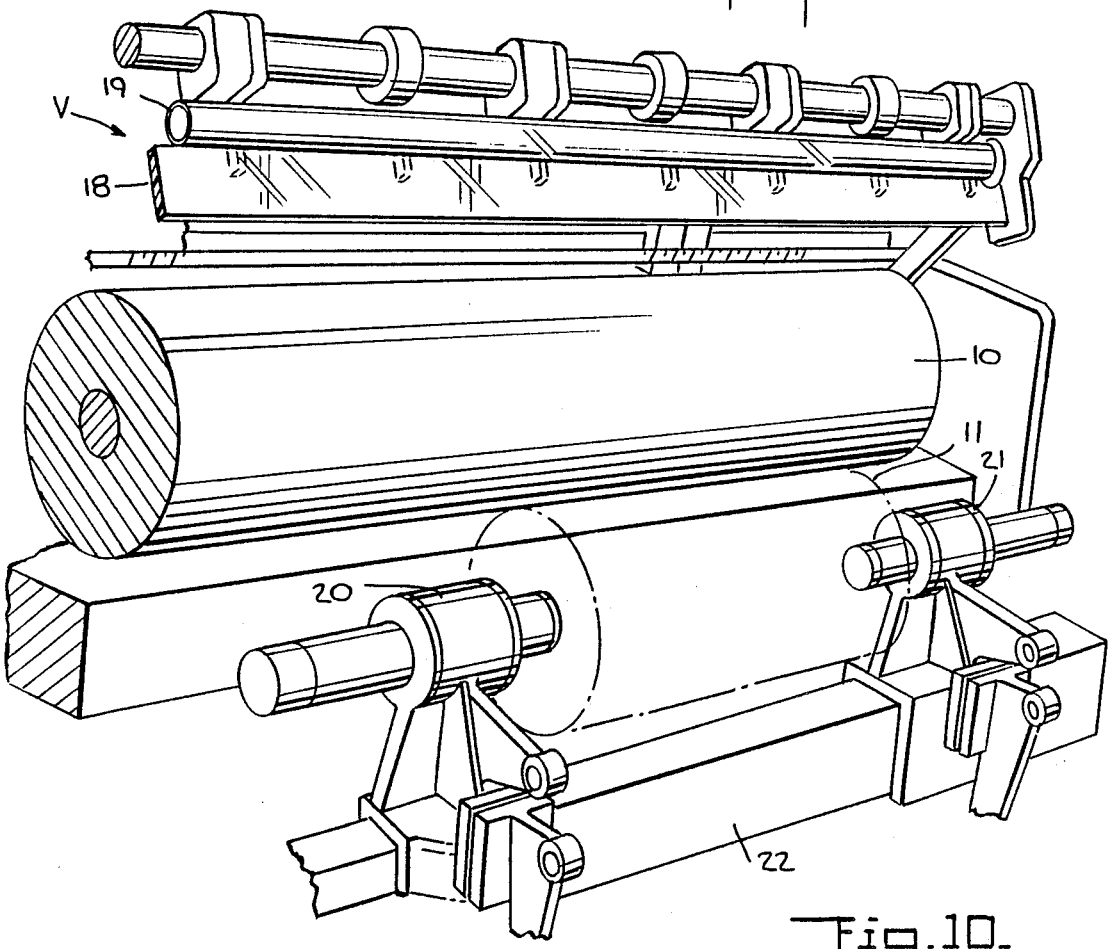
FIG. 2 is a perspective view of the machine in its proofing state.

1. Structure of Machine:

Referring now to FIGS. 1, 2 and 3, the mounting proofing machine in accordance with a preferred embodiment of the invention is shown, the transfer tray being omitted from the figures in order to illustrate how the machine operates to effect mounting of standard rubber flexographic printing plates by means of optical registration. To this extent, the details of this machine correspond to those in the above-identified Hoexter patent whose disclosure is incorporated herein.

The machine includes an impression cylinder 10 of large diameter which is mounted for rotation on a shaft about a fixed horizontal axis. Associated with impression cylinder 10 is an impression cylinder (IC) gear 12 of the same diameter mounted for rotation about a horizontal axis on a second shaft, the second shaft being movable from a position in which it is coaxial with the first shaft to a parallel position displaced from the first shaft. The shaft of the IC gear is mechanically interlinked to the shaft of the impression cylinder by means of a parallel displacement coupling (not shown), so that rotation of IC gear 12 results in like rotation of the impression cylinder regardless of the relative positions of the two shafts and without generating perturbing forces or torques.

Also provided is a plate cylinder 11 of whatever diameter is appropriate to the flexographic job to be performed. The plate cylinder is rotatable about a parallel horizontal axis on a third shaft which is movable in a vertical plane which is displaced from the fixed horizontal axis, the plate cylinder being shiftable from a proofing state, as shown in FIGS. 1 and 2 to a mounting state as shown in FIG. 3.

Mounted on the shaft of plate cylinder 11 is a plate cylinder (PC) gear 13 of the same diameter. The PC gear travels with the plate cylinder and is always concentric therewith, whereby a given angular displacement of PC gear 13 results in exactly the same angular displacement of plate cylinder 11.

PC gear 13 always remains in intermeshing relationship with IC gear 12, so that in either the proofing or the mounting state, a rotation of impression cylinder 10 in one direction is transmitted by the parallel displacement coupling to IC gear 12 and by way of PC gear 13, produces a rotation of plate cylinder 11 in the reverse direction to an extent determined by the ratio of these gears.

Thus if impression cylinder 10 is turned clockwise, plate cylinder 11 is caused to turn in the counterclockwise direction. The shaft of IC gear 12 is supported for rotation in a bearing at the free end of a swingable impression cylinder gear arm 14, so that when plate cylinder 11 shifts from its proofing state to its mounting position, as a consequence of which IC gear 12 is lowered from its initial position concentric with the impression cylinder, arm 14 is caused to swing downwardly in an arc.

The other end of the swingable impression cylinder gear arm 14 is pivotally connected to a crank 15 operated by a pneumatic cylinder 16 so that the arm may be shifted axially to a predetermined extent limited by stops, thereby causing IC gear 12 carried thereby to shift in the same direction. Assuming that PC gear 13 is kinematically locked against rotation, then when IC gear 12 which engages PC gear 13 is shifted by arm 14, IC gear 12 is caused to ride on the PC gear and to rotate, this rotation being transmitted to impression cylinder 10.

A viewer V is provided having a partial mirror, the viewer being activated in the proofing state and being brought into an operative position in the mounting state, as shown in FIG. 3. In the operative position of viewer V, the operator is able to see in the mirror both the surface of impression cylinder 10 and the surface of plate cylinder 11, these surfaces appearing in superposed relation.

When in the proofing state, plate cylinder 11 makes contact with impression cylinder 10, as shown in FIG. 1, a print point on the printing plate carried by the plate cylinder will be impressed on the proof sheet carried by the impression cylinder. This print point, as it appears on the plate cylinder, will be referred to as print point 1, and the physically coincident point appearing on the impression cylinder will be identified as print point 1'.

In order to obtain optical coincidence between the images of print points 1 and 1' in viewer V when these points are separated from each other in the mounting state of the cylinders, it is necessary to rotate the two cylinders to cause these points to merge in viewer V.

FIGS. 1 and 2 illustrate the relationship existing between impression cylinder 10 and plate cylinder 11 in the proofing state. In this state, IC gear 12 is concentric with impression cylinder 10, the gear being supported at the end of impression cylinder gear arm 14. Plate cylinder 11 is now in contact with impression cylinder 10 to effect a proofing action in which the print point 1 on plate cylinder 11 is physically coincident with point 1' on impression cylinder 10.

FIG. 3 illustrates the relationship of the cylinders in the mounting state after plate cylinder 10 has been lowered and viewer V is in its operative position. As plate cylinder 11 descends in a vertical plane, point 1 therein remains at the same angular position, but point 1' on impression cylinder 10 is angularly displaced in the counterclockwise direction to an extent determined by the gear ratio between PC gear 13 and IC gear 12, for as PC gear 13 is lowered, arm 14 swings downwardly through an arc causing IC gear 12 to rotate in the counterclockwise direction with respect to PC gear 13 which is effectively locked in position.

In order to bring about optical coincidence between points 1 and 1' in the mounting state, it is necessary that these points be brought in observation sites 0 and 0', respectively. Site 0 is at zero degrees on the plate cylinder directly below the optical axis of viewer V, and it is spaced therefrom by a distance X. Site 0' on the impression cylinder is an equal distance X' from the optical axis of viewer V, this site lying at the intersection of a line from this optical axis and the tangent of the impression cylinder. The angle defined by the plane of the viewer mirror and the line extending to site 0 is equal to the angle defined by the same plane and the line extending to site 0'.

To bring print point 1 on plate cylinder 11 to observation site 0, one must rotate plate cylinder 11 and PC gear 13 coupled thereto in the counterclockwise direction until print point 1 is at zero degrees. Print point 1 is now properly placed with respect to viewer V. But in so turning plate cylinder 11 and PC gear 13, this causes IC gear 12 and impression cylinder 10 coupled thereto by the parallel displacement coupler to turn in the clockwise direction to a degree determined by the gear ratio. As a consequence, print point 1' on the impression cylinder overshoots observation site 0'.

The resultant phase displacement $\ominus$ between print point 1' on the impression cylinder and observation site 1' represents the extent of correction required to bring the print point to its proper position relative to viewer V. The required amount of correction depends on the relative diameters of the cylinders, so that a phase correction for a plate cylinder of a particular diameter is inappropriate to a plate cylinder of a different diameter.

To effect the required correction for different plate cylinders, swing arm 14 is shifted axially by crank 15 which is driven by pneumatic cylinder 16. Since plate cylinder 10 and PC gear 13 coupled thereto are kinematically locked to maintain print point 1 at observation site 0, in shifting arm 14 axially, IC gear 12 is forced by the arm to ride on PC gear 13 and to rotate in the counterclockwise direction. Because PC gear 13 is linked by the parallel displacement coupler to impression cylinder 10, this cylinder undergoes a corresponding counterclockwise rotat-on.

The shift of arm 14 is arrested by an adjustable mounting position nut 17 which engages the foot of crank 15 at a point at which print point 1' on the impression cylinder occupies the observation site 0', so that now print points 1 and 1' are optically coincident in viewer V. Inasmuch as different phase corrections are required for plate cylinders of different diameters, each time a cylinder of different diameter is installed in the mounting-proofing machine, an appropriate adjustment of stop 17 must be made. The shift of arm 14 in the proofing position is arrested at the same point by a fixed stop associated with the upper end of the crank.

We shall now summarize the procedure for operating the mounting-proofing machine.

First, plate cylinder 11 is raised to the proofing state in which a print point 1 on plate cylinder 11 makes contact with the impression cylinder to produce a coincident print point 1' thereon.

Second, plate cylinder 11 is lowered to its mounting state and viewer V is brought down into its operative position at which an observation site 0 on plate cylinder 11 is optically coincident with an observation site 0' on impression cylinder 10. But print point 1 on the plate cylinder is not at site 0 nor is print point 1' on the impression cylinder at site 0'.

Third, plate cylinder 11 is turned until print point 1 thereon occupies observation site 0, as a result of which print point 1' on impression cylinder 10 is carried to a site which overshoots observation site 0' thereon.

Fourth, cylinder 16 is actuated to force arm 14 which carries IC gear 12 to shift to an extent limited by stop 17 to cause gear 12 to turn impression cylinder 10 to an extent bringing print point 1' thereon to observation site 0', whereby print points 1 and 1' are now optically coincident in viewer V.

The mounting-proofing machine is shown in FIG. 2 with the viewer V in its retracted state, the viewer including a partial mirror 18 and a fluorescent light tube 19 to illuminate the images being viewed. Plate cylinder 11, which is shown in dotted lines, is held between a pair of chucks 20 and 21 which are slidable along an elevator beam 22 to accommodate the space between chucks to the length of the plate cylinder held thereby. A PC gear, not shown in FIG. 2, is attached coaxially to the righthand chuck 21 so that this gear turns together with the plate cylinder.

Elevator beam 22 is mechanically operated to raise and lower plate cylinder 11, as required, into contact with impression cylinder 10 in the proofing state and separately therefrom in the mounting system, A pneumatic cylinder is provided to swing viewer V down into its operative position in the proofing state.

As shown in FIG. 3, a proof sheet 23 is taped to impression cylinder 10. Accurate layouts for the first down or key color may be drawn quickly and without difficulty by means of a calibrated band ruler 24 and marking pen 25. Graduated in both directions from zero, the band ruler can be moved to set the zero point whenever desired.

FIG. 2 shows plate cylinder 11 in contact with impression cylinder 10; hence in this state, IC gear 12 is concentric with impression cylinder 10. Plate cylinder 11, which is raised to its proofing state by elevator beam 22, cooperates with a sensing arm which is arranged to actuate a switch so as to deenergize the elevator motor when the plate cylinder reaches its proper mounting position. For sensing the proper proofing position, gear arm 14 carries a limit switch actuator.

Retractable viewer V is mounted at the end of pivoted arms which is operated by a pneumatic cylinder, the cylinder raising the viewer above the impression cylinder in the proofing state and bringing it down into its operative position when the plate and impression cylinder are in the mounting state.

It will be seen that crank 15, to which one end of IC gear arm 14 is coupled, is mounted to rock with respect to a fixed pivot point 26, the crank having an extension finger 27 which cooperates with stop 17 whose setting determines the extent of phase correction. Stop 17 is mounted on a threaded bolt 28 having a handle 29 attached to its head, so that by manually turning this bolt with respect to a stationary sleeve 30 threadably engaging the bolt, the position of stop 17 relative to finger 27 may be adjusted. It will also be seen that crank 15 is operatively coupled to pneumatic cylinder 16, whereby when this cylinder is actuated, IC gear arm 14 is shifted t cause IC gear 12 to ride on PC gear 13 and to rotate to an extent necessary to effect the required phase correction.

The Support Tray

Figure 4:
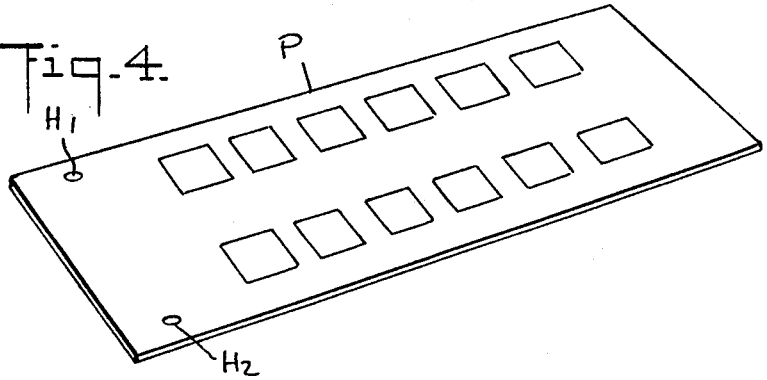
FIG. 4 illustrates a typical flexographic printing plate having registration holes.

The mounting-proofing machine shown in FIGS. 1 to 3 is also usable to effect pin registration of flexographic printing plates, such as plate P shown in FIG. 4, having a pair of registration holes $H_1$ and $H_2$ drilled therein at positions outside of the image area on the printing plate.

Figure 5:
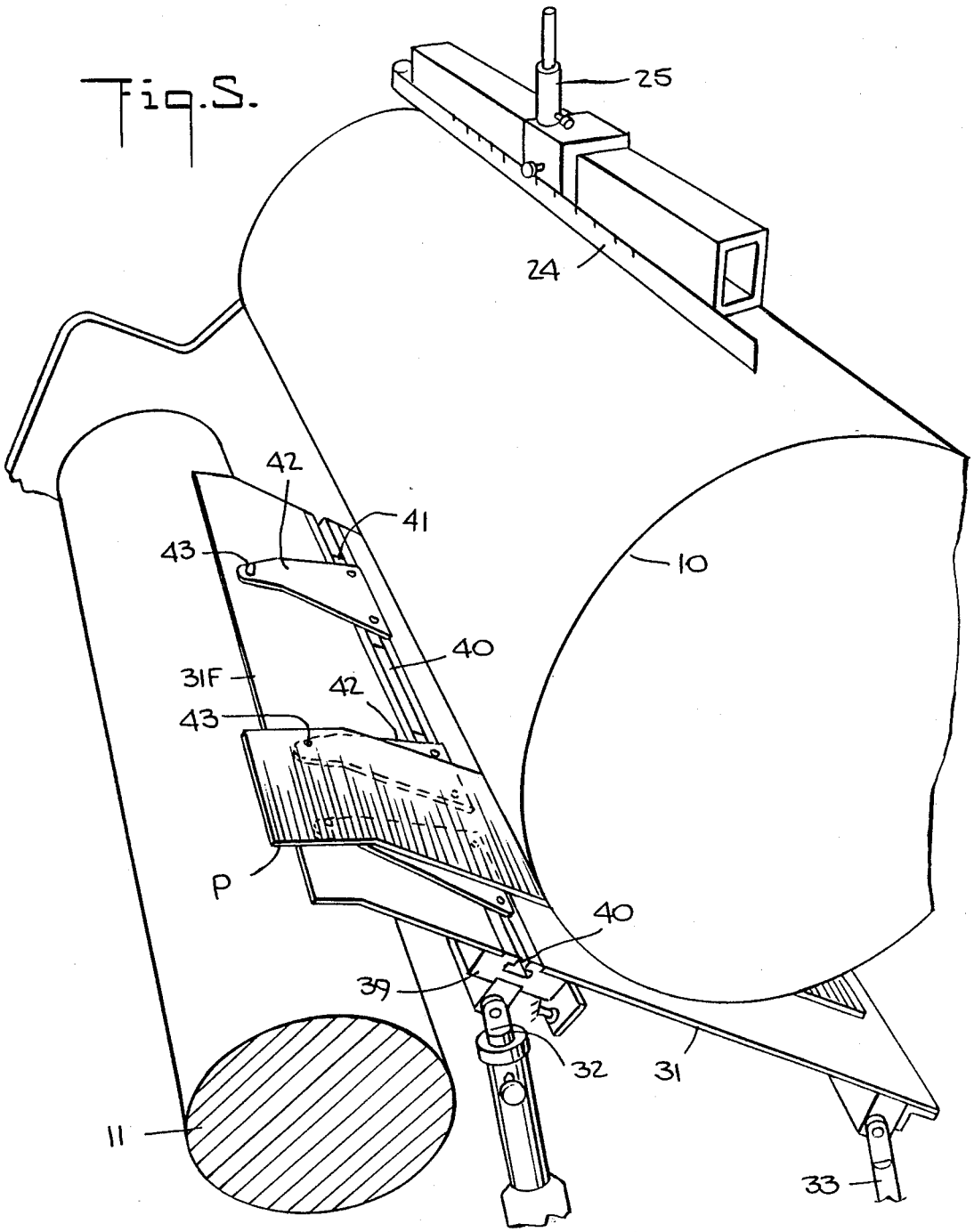
FIG. 5 is a perspective view of the machine in its mounting state when used for pin registration, with the support tray then in its operative position on the plate cylinder.
Figure 6:
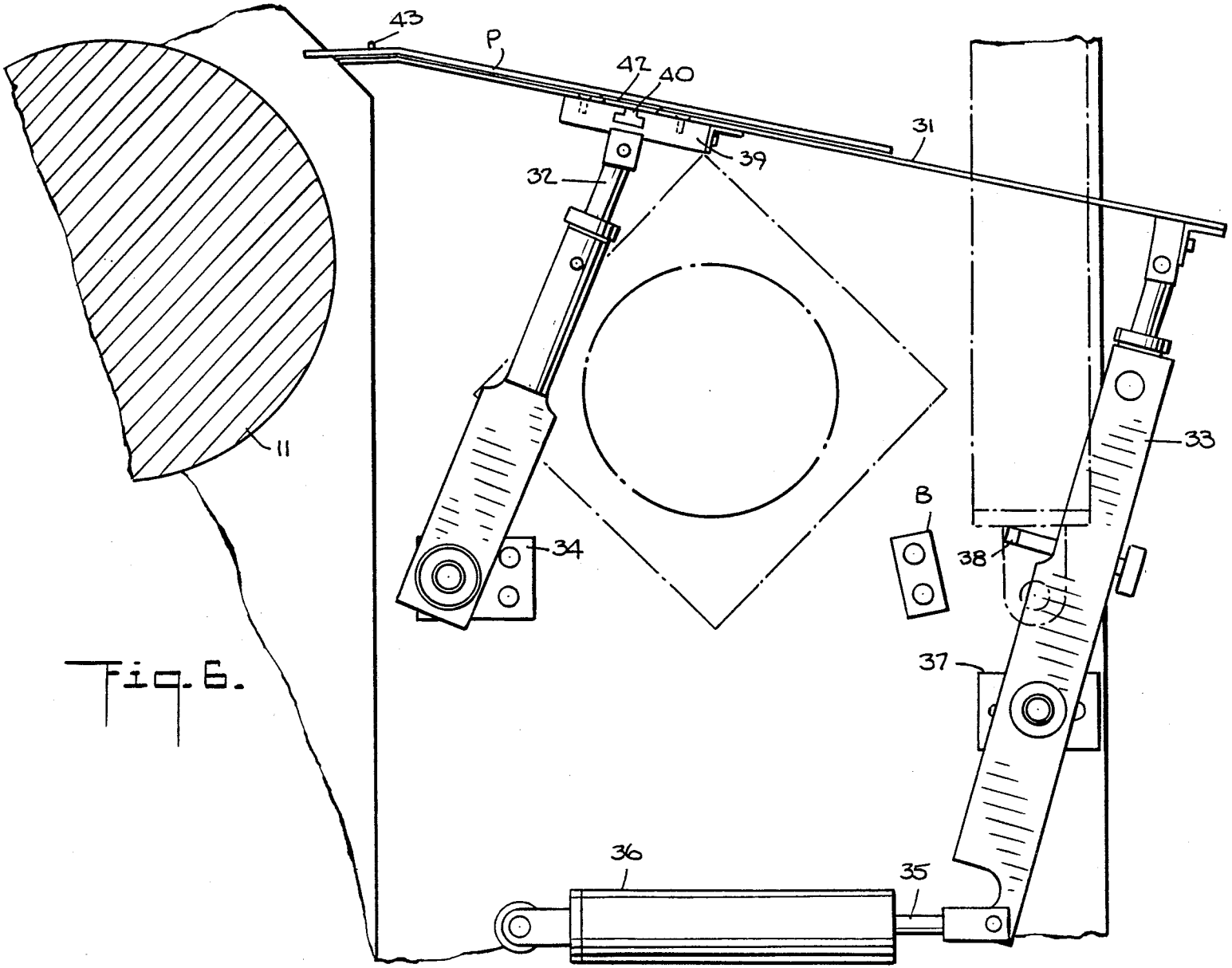
FIG. 6 is a side view of the support tray and the operating mechanism therefor in its retracted position with respect to the plate cylinder.

In order to effect registration, the machine is provided, as shown in FIGS. 5 and 6, with a support tray 31 which cooperates with plate cylinder 11. The tray is shiftable from a retracted state, as shown in FIG. 6, to an operative state in which, as shown in FIG. 5, the straight leading edge 31F of the tray is parallel to the long axis of plate cylinder 11 and tangentially engages the surface of this cylinder.

Tray 31 is pivotally supported on a front arm 32 and a rear arm 33, the lower end of front arm 32 being pivotally held on a support block 34. The lower end of rear arm 33 is pivotally coupled to the piston rod 35 of an air cylinder 36, this arm being pivoted at an intermediate position on a support block 37. Hence when air cylinder 36 is actuated to cause the axial advance of its piston rod 35, this action causes rear arm 33 to swing to shift transfer tray 31 to its operative state, the swing being limited by a stop block 37 associated with an adjustable set screw 38 on arm 33.

To accurately position the tray at the forward or mounting position, one may provide for this purpose adjustable fixed stops for front-to-back location, and a V-stop to provide left-to-right position, respectively (not shown).

Figure 10:
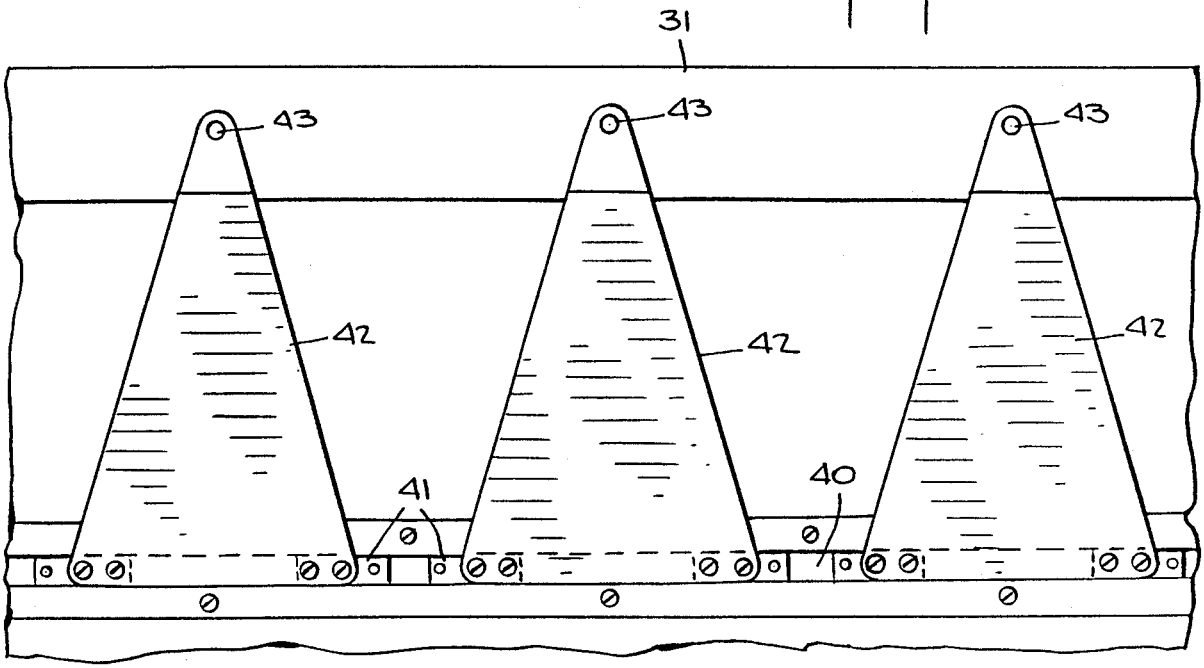
FIG. 10 shows in plane view three pin-registration extensions fixed on the support tray.
Figure 7:
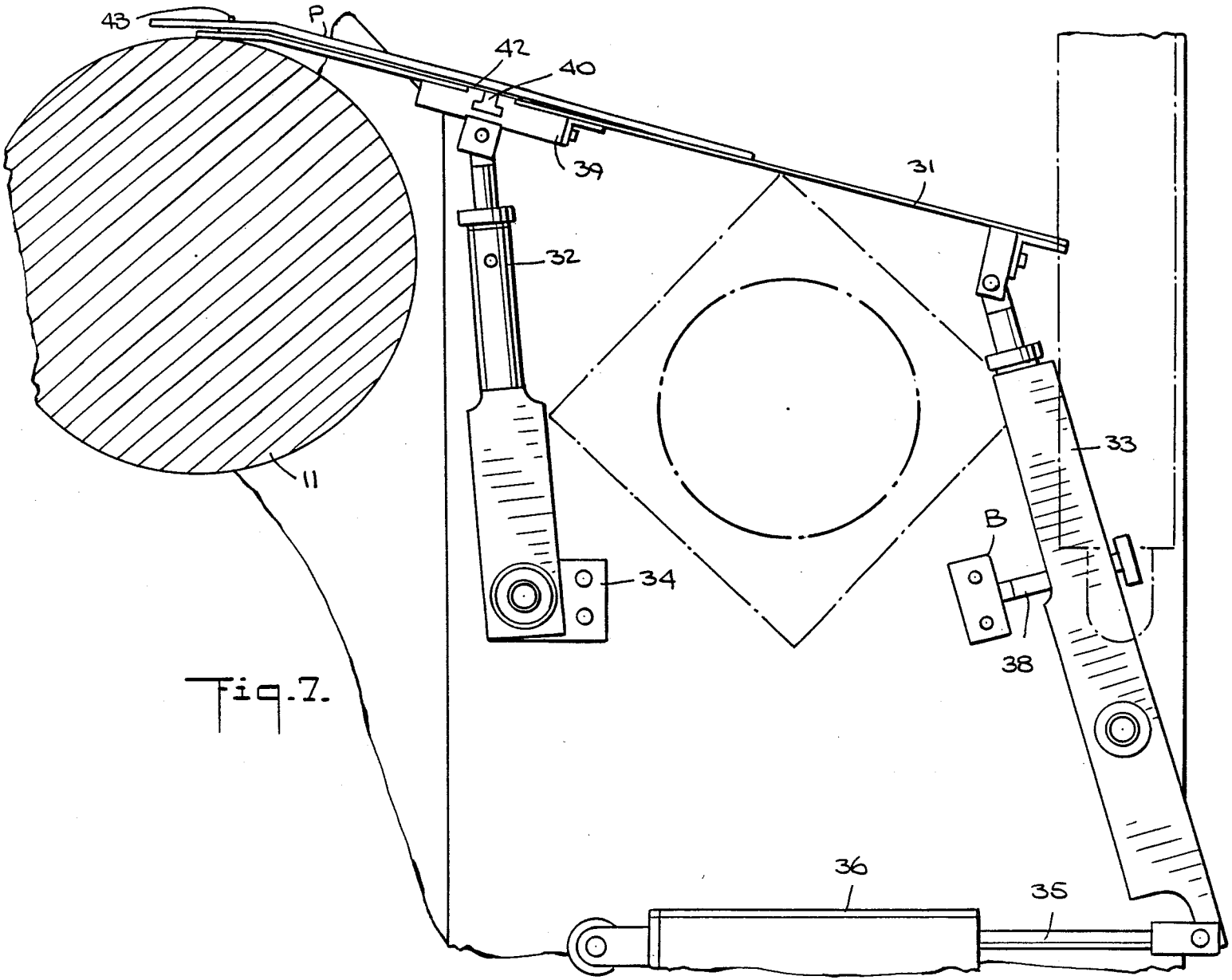
FIG. 7 is a side view of the support tray to its operative position on the plate cylinder.

Tray 31 is provided with a cross piece 39 having a track 40 therein, the cross section of the track being that of an inverted T. Slidable in track 40, as shown separately in FIGS. 10 and 11, are slide blocks 41. Each block includes a fastener SS to hold the block at a desired position along the track, each slide block being provided, if necessary, with a registration pin. Alternatively, securable to the blocks are flat triangular metal extensions 42, each having an upright registration pin 43 adjacent its apex, the diameter of the pin matching the diameters of the holes $H_1$ and $H_2$ in the printing plate P. The front portion of each extension, as shown in FIGS. 7 and 8, is bent down to conform to the bend (see FIG. 5) in the front portion of the tray, so that the extension follows the curvature of the tray.

Thus the extensions carried by the slide blocks may be positioned so that their registration pins are inserted in the several printing plates to be transferred to the plate cylinder along its length. For normal size printing plates, these plates are located directly on registration pins carried by the slide blocks, the extensions being used only for very short printing plates. Thus a threaded hole on the slide block can be used to receive a registration pin or a machine screw to hold the extension.

The sites of registration holes $H_1$ and $H_2$ on printing plate P are such that when the plate is on the tray with the registration pins inserted in these holes to orient the printing plate, the front margin of the printing plate then overhangs the leading edge of the tray and overlies the sticky surface of plate cylinder 11, as shown in FIG. 5. Hence by pressing the overhang of the printing plate onto the sticky surface, it will adhere thereto.

By slightly lifting the printing plate from the tray to effect its disengagement from the registration pins on the lugs, and then causing plate cylinder 11 to turn clockwise, the remainder of the printing plate is brought into contact with the surface of the cylinder and is adhered thereto. One can, in the manner previously described, after the printing plates are properly mounted on the plate cylinder, then elevate the plate cylinder to its proofing state to take a proof of the printing plates on the impression cylinder.

Therefore, in order to print an image in three colors, one needs for this purpose three flexographic printing plates, one of each color, each provided with registration holes. With the present invention, each of the three printing plates is mounted at corresponding positions on respective plate cylinders so that the three color printings will be in exact registration. And since it is possible with the mounting-proofing machine to obtain on a proof sheet on the impression cylinder, superposed proofs of the three color plates, one can tell from the final proof whether proper multi-color registrations exist before commencing printing.

In practice, the control switches on the machine for operating the cylinders and the transfer tray are interlocked, so that the air cylinder for operating the tray cannot be actuated to cause the tray to shift to its operative position unless the plate cylinder is in its mounting state and is not rotating.

And the same machine can be used to effect registration by optical means of those flexographic printing plates which lack registration holes, so that a separate mounting-proofing machine for this purpose is not required.

In the embodiment disclosed herein, the plate cylinder is described as being shiftable relative to the impression cylinder which rotates on a fixed axis. The invention is also applicable to those machines in which the impression cylinder is shiftable with respect to a plate cylinder rotatable about a fixed axis.

Because in an arrangement in accordance with the invention the flexible printing plate is supported by the tray in the horizontal plane, this avoids stretch and other distortions that may be experienced due to the weight of the plate if it were held in the vertical plane as in prior pin registration arrangements.

A pin registration facility in accordance with the invention permits the use of many small pin-registrable printing plates to be mounted in a desired layout for multiple images across and around the plate cylinder.

While there has been shown and described a preferred embodiment of a flexographic printing plate transfer tray for mounter-proofer machine in accordance with the invention, it will be appreciated that many changes and modifications may be made therein without, however, departing from the essential spirit thereof.

Thus the invention is by no means limited to a mounting-proofing machine of the type disclosed herein.

I claim:

1. A flexographic mountingproofing machine for use with a flexible printing plate having registration holes therein, said machine comprising:

(a) an impression cylinder rotatable about a first horizontal axis;

(b) a plate cylinder rotatable on a second horizontal axis parallel to the first axis and having a sticky surface;

(c) means to shift said plate cylinder relative to the impression cylinder from a mounting state in which it is separated from the impression cylinder to a proofing state in which the plate cylinder makes contact with the impression cylinder whereby a proof can be made of said flexible printing plate when it is mounted on the plate cylinder; and (d) a support tray for facilitating transfer of said printing plate to said plate cylinder, so that it can be mounted thereon, said tray having a leading edge which is parallel to the axis of the plate cylinder, and means to shift the tray from a retracted position to an operative position in which its edge tangentially engages the surface of the plate cylinder; and (e) slide blocks supported on said tray and slidable thereacross, each block carrying a registration pin whereby the sites of the pins carried by the slide blocks are adjustable to cause the pins to engage the registration holes of the printing plate to be mounted on the plate cylinder and the front margin of the printing plate then overhangs the leading edge of the tray and makes contact with the sticky surface of the plate cylinder, whereby by then disengaging the printing plate from the pins and rotating the plate cylinder, the remainder of the printing plate can be accurately transferred to occupy a desired position on the plate cylinder.

2. A machine a set forth in claim 1, wherein said tray is pivotally supported on a front arm and a rear arm, the lower end of the front arm being pivotally coupled to a support block, the lower end of the rear arm being pivotally coupled to a piston rod of an air cylinder, the rear arm being pivoted at an intermediate position on a second support block, whereby when the air cylinder is actuated to cause axial advance of its piston rod, this action causes the rear arm to swing to shift said support tray to its operative state.

3. A machine as set forth in claim 1, wherein each registration pin is carried by its slide block by an extension having a triangular form whose base is attached to the slide block, and whose apex is displaced from the base, the registration pin being mounted on said apex of the extension.

4. A machine as set forth in claim 1, wherein said tray is provided with a cross piece having a track therein whose cross section is that of an inverted T, said slide blocks being slidable in said track.

5. A machine as set forth in claim 4, wherein each slide block is provided with a fastener to maintain said slide block at a desired position on said tray.

6. A machine as set forth in claim 1, further including an optical viewer which is usable to effect registration of a flexible printing plate lacking registration holes whereby the same machine can be used for either said flexible printing plate having registration holes therein, in which event the support tray serves to effect registration thereof, or with said flexible printing plates lacking registration holes, in which event registration is effected with said optical viewer.

7. A machine as set forth in claim 1, wherein said tray supports said printing plate in a substantially horizontal position.

* * * * *